US005564243A

United States Patent [19]

Kroll et al.

[11] Patent Number: 5,564,243

[45] **Date of Patent: *Oct. 15, 1996**

[54] INSULATIVE WALL CLADDING HAVING INSULATION BOARDS FITTING TOGETHER TO FORM CHANNELS AND FIRE-RETARDANT PANELS DISPOSED THEREIN

[76] Inventors: Richard E. Kroll; Vincent Tamburrini, both of One Energy Way, West Warwick, R.I. 02893; Frederick M. Hansen, 129 Ringwood Drive, Stouffville Ontario, Canada, L4A 8C1

[ * ] Notice: The term of this patent shall not extend beyond the expiration date of Pat. No. 5,363,621.

[21] Appl. No.: 323,791

[22] Filed: Oct. 17, 1994

Related U.S. Application Data

[63] Continuation of Ser. No. 25,381, Mar. 2, 1993, Pat. No. 5,392,578, which is a continuation-in-part of Ser. No. 12,161, Jan. 28, 1993, Pat. No. 5,363,621.

[51] Int. Cl.[6] ..... E04B 2/00

[52] U.S. Cl. ..... 52/506.1; 52/404.4; 52/302.3; 52/302.4; 52/302.1; 52/269

[58] Field of Search ..... 52/506.1 OR, 52/404.4, 302.3, 302.4, 302.1, 507, 508, 235, 267, 268, 269

[56] References Cited

U.S. PATENT DOCUMENTS

| | | | |
|---|---|---|---|
| 3,121,977 | 2/1964 | Bersudsky | 52/506.01 |
| 5,398,473 | 3/1995 | Chan | 52/235 X |

*Primary Examiner*—Carl D. Friedman
*Assistant Examiner*—Wynn E. Wood
*Attorney, Agent, or Firm*—Cushman Darby & Cushman, L.L.P.

[57] ABSTRACT

A wall of a building includes cladding having a plurality of interconnecting air pressure and moisture vent channels. The cladding prevents formation of an air pressure differential between the outside atmosphere and the inside atmosphere of a building or the atmosphere in a cavity of the cladding, which reduces moisture ingress. Preferably, cladding having fire retardant panels is further provided in the wall.

33 Claims, 9 Drawing Sheets

FIG. 1B.
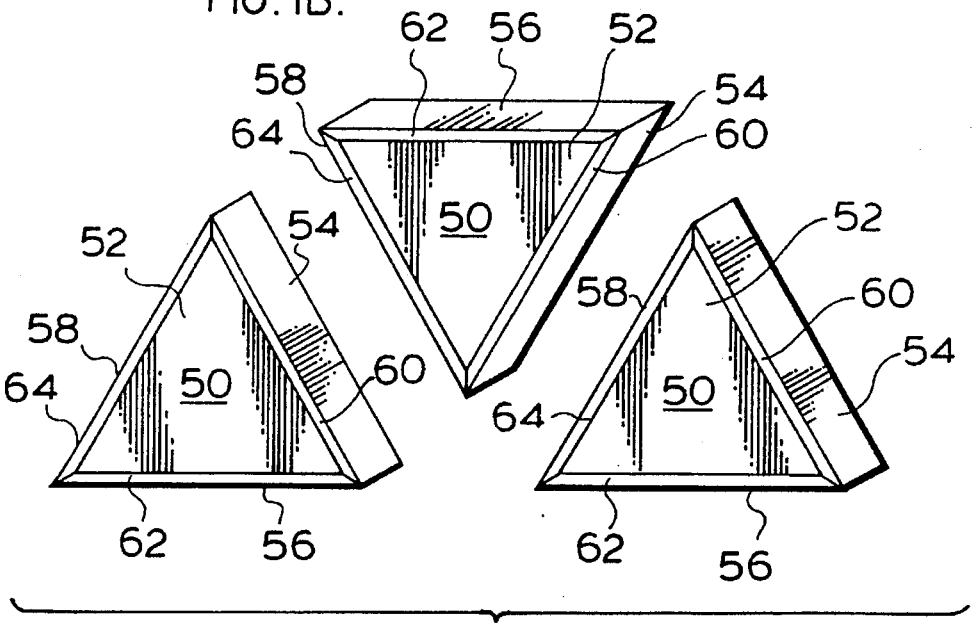
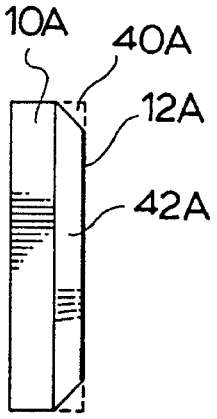
FIG. 2A.
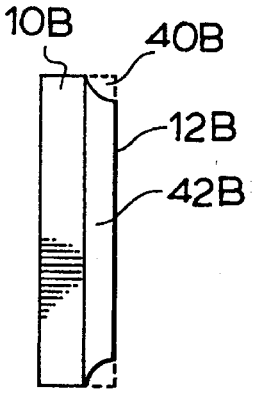
FIG. 2B.
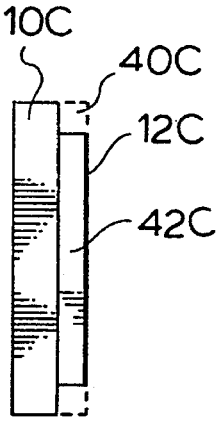
FIG. 2C.

300
306
302
304
308

10(100)
204
200
202
32
34
220
220
222
220
224
226
228

INSULATIVE WALL CLADDING HAVING INSULATION BOARDS FITTING TOGETHER TO FORM CHANNELS AND FIRE-RETARDANT PANELS DISPOSED THEREIN

RELATED APPLICATIONS

This application is a continuation of application Ser. No. 08/025,381, filed Mar. 2, 1993 now U.S. Pat. No. 5,392,578, which is a application Ser. No. 08/012,161, filed Jan. 28, 1993, which is now U.S. Pat. No. 5,363,621.

BACKGROUND OF THE INVENTION

1. Field of the Invention

This invention relates to insulative cladding of walls of buildings, particularly to thermal and waterproof insulative cladding, and to insulation boards and battens of use in said cladding.

2. Description of the Related Art

Walls of buildings that are not formed of reinforced concrete typically comprise structural support members made of steel, concrete and like materials and having cladding disposed therebetween. The outer face of the cladding is generally provided with a decorative finish such as, for example, a polished granite slab, a brick wall or an exterior finish layer having an outer surface of a polymer/particulate decorative material. In the latter case, the exterior finish is also provided as a rain-fast surface.

Certain types of walls of buildings have an inner cavity between the outer cladding and an inner wall, typically consisting of a plasterboard material. The aforesaid cavity communicates with the outside atmosphere to provide an air pressure equalization chamber and water vent conduit for water ingressing through the outer cladding. Notwithstanding the high degree of care during construction to provide a water-impermeable i.e., rain-fast membrane to the outside cladding surface, over periods of time under the influence of wind and rain, temperature and frost and the like, hair-line cracks invariably are formed in the rain-fast layer to permit said ingress of moisture through the cladding to the cavity and into the interior of the building. Accordingly, the cavity must communicate with a weep or vent hole or channel to prevent build-up of water within the cavity.

One successful form of insulative cladding presently in use that does not require the presence of an inner cavity comprises a multi-layer insulation board having a typically 6–8 cm thick layer of insulating foam, such as, expanded polystyrene, polyurethane, urea-formaldehyde or mineral wool. Adhered to the inner surface of the foam layer is, typically, a gypsum plasterboard layer of approximately 2 cm thickness. On the outer surface of the foam layer is a reinforcing layer of two or more glass fibre meshes floated in a polymer-cement modified basecoat. This basecoat protects the foam insulation layer from both physical damage and moisture ingress. To the outer basecoat layer is provided an exterior decorative layer of a polymer-particulate material, typically, sand dispersed in an acrylic polymer.

Such multi-layer insulative cladding is formed, generally, as a handleable, rectangular batten or board of dimensions of 1.2 m×0.6 m×8 cm comprising 4.0 cm form insulative material.

Each of the composite layered battens or boards may be made in situ, i.e., the inner plasterboard and outer waterproofed layers may be adhered to the foam layer after the wall of insulative foam has been constructed, one batten upon another batten, during construction. Alternatively, the insulative battens and boards may be pre-fabricated and shipped to the construction site. The cladding comprising a plurality of the insulation boards or battens is formed by the plurality of insulation boards being cooperatively bonded in adjacent relationship as to provide insulation to the wall. Such construction lies well within the skill of plasterboard tradesmen. Battens are abutted one on top of and next to other similar battens and caulked or the like to fill in any gaps or voids between battens. Suitable connections to the structural supports of the walls of the building are made.

In considering the desirability of a particular type of insulative cladding for use in a wall, regard must be had to the effect of wind pressure and rain on the outer wall. In the absence of direct communication between the outside atmosphere and the atmosphere inside the building and/or any-cavity, significant air pressure differentials may exist dependent on the wind speed and the like. In consequence of this relatively large pressure differential between the outside and inside of the building created by strong winds acting on the wall, significant water ingress through hair-line cracks and other unintentional openings and the like readily occurs. In the absence of a cavity in the wall, such moisture will reach and damage the inside surface of the wall of the building. Accordingly, cavities are most preferred in walls, to prevent water ingress, provided the cavity is vented to atmosphere to allow for pressure equalization and accumulative water run-off out of the cavity. Thus, cladding systems relying solely-on outer face sealing materials suffer the risk of water ingress over time, enhanced by air pressure differentials, rain, and successive freezing and thawing of water contained within the cladding.

Thus, while the composite layered cladding of the prior art provides a generally satisfactorily cladding which readily enables a decorative cladding system of a wall to be satisfactorily and quickly constructed, such a resultant wall often suffers from the effects of water damage under the air pressure differentials as aforesaid described, in the absence of an outside air-vented cavity.

SUMMARY OF THE INVENTION

It is an object of the present invention to provide an improved cladding for the wall of a building which can be readily constructed on-site and which provides air pressure equalization with the outside air.

It is a further object of the invention to provide improved insulation boards or battens for use in the aforesaid improved cladding of the wall of the building.

These and other objects and advantages of the invention will become readily apparent to the man skilled in the art from a reading of this specification as a whole.

Accordingly, the invention provides in its broadest aspect a wall of a building comprising cladding having a plurality of interconnecting air pressure and moisture vent channels.

The invention provides in a further broad aspect an improved cladding of the wall of a building, said cladding comprising a plurality of insulation boards in cooperative, adjacent relationship as to provide insulation to the wall, the improvement comprising said boards being so shaped as to provide said cladding with a plurality of interconnecting air pressure equalization and vent channels in said cladding.

By "cooperative, adjacent relationship" is meant that the insulation boards are built or layered one adjacent or atop another between the structural support members of the wall as is presently done in the art as to provide an insulation layer to the wall.

By the term "cladding with a plurality of interconnecting air pressure equalization and moisture vent channels" is meant cladding having a plurality of criss-crossing channels throughout a desired area of the cladding. It is not meant to include cladding having a plurality of parallel vertically aligned channels which intersect solely with a single, horizontally aligned channel extending across the width of the cladding, particularly, at a lower part thereof.

The boards are so shaped such that when they are part of the wall they produce, in consequence of adjacent relationship with other boards, a plurality of channels which interconnect with each other and via a lower vent member with the outside atmosphere. The plurality of channels may extend substantially across the full area-of the cladding or, if desired, only a part thereof. The wall may be provided with intervening structures such as doors or windows which may abut, directly or indirectly, insulation boards according to the invention, but which wall still satisfactorily satisfies the object of the invention.

Although the invention includes cladding comprising boards as hereinabove defined wherein the vertically aligned channels communicate with horizontally aligned channels at the sides, faces and edges, cladding formed of a plurality of boards having a plurality of vertically aligned channels on a full face of the board, which channels must be in alignment contiguous with the plurality of upwardly aligned channels of at least one other board resting upon it. Provided that the full face also has a portion defining a lateral channel which interconnects with the upwardly aligned channels to provide an interconnecting air pressure equalization and vent channel.

Each of the insulation boards may be of any suitable shape and dimension. Preferably, the board is roughly a 1.2 m×0.6 m×8.0 cm rectangularly shaped batten of insulative material. Alternatively, each of the battens may be of other shapes, such as a triangle.

The battens may be so shaped as to provide suitable interconnecting channels of appropriate location, shape and dimension to permit satisfactory air pressure equalization and water removal. In one embodiment, the batten has cut-away edge portions along at least a portion of at least one edge of a first face which preferably constitutes the inner face of the cladding. The cut-away portion may be defined by the edge surface as a quadrant arcuate form, semi-square form or 45 degree angled form. In an alternative channel forming board of the invention, the board has a trough extending at least partly along at least one side of the board. Preferably, the trough extends the whole length and midway of each of the sides.

Surprisingly, we have found that a relatively small vent hole in communication with the interconnecting air pressure equalization channels provides satisfactory equalization.

The cladding and the multi-layered boards have preferably an airtight inner barrier either adhered thereto, or disposed or adjacent in close proximity thereto.

Thus, in a further aspect the invention provides insulation boards as herein defined for use in the improved cladding of the wall of a building as herein defined.

one very important consideration that must be given to the construction of wall cladding, particularly, cladding of commercial and industrial buildings, is that concerning fire prevention and retardation. Wall cladding comprising expended polystyrene (EPS) of the prior art is provided with a back wrapping comprising a glass fiber mesh embedded in a cement modified acrylic polymer base coat, which envelopes, at least, the EPS.

Prior to the commercial introduction to the trade of a novel wall cladding for use in a commercial or industrial building, the wall materials and constructed wall must undergo extensive, standard fire testing. In one such test, a flame is played onto the back wrapping of the EPS insulative cladding to determine whether the resultant system meets the regulatory requirements.

It is known that EPS melts ca 170° C. to a viscous, but mobile fluid. Thus, in the wall cladding structure according to the invention, it is reasonable to expect that, notwithstanding the fire retardancy of the conventional back wrapped EPS, under certain extreme high temperature conditions the EPS may melt and exit to and through the lower air pressure equalization and moisture vent channels of the panels and cladding according to the invention. Further, it is realized that the channels may also constitute passages in the cladding by which flames and hot gases may rise throughout the cladding in the event of a fire.

Accordingly, to reduce the possibility of the channels in the cladding acting as such flame passages, the invention provides in a further aspect, wall cladding of a building as hereinabove defined wherein a portion of a least one of said channels is filled with a flame resistant, fluid pervious, particulate material.

By "fluid pervious" is meant that air may readily pass through the material to allow of rapid air pressure equalization when subjected to external wind effects and the like, and also allow water to be vented through and out of the channels. Clearly, such material must not be capable of being burnt in the event of a fire. Suitable materials include solid particulate material such as insulative vermiculite but most preferably, mineral wool and glass fiber in the form of intermeshed strands or layers. Provided that the location and volume of the flame resistant material in the channel is sufficient to prevent propagation of the flame and also to absorb, hold-back or otherwise prevent or restrain any melted EPS from exiting out of the flame resistant material from the cladding, enhanced flame retardation and improved fire safety can be achieved.

In its simplest form, this aspect of the invention comprises a wedge of the flame retardant material disposed within at least a sufficient number of channels to properly achieve the fire retardant and air pressure equalization goal. Most frequently, the material will be disposed within channels at a suitable lower place thereof, to optimally trap any melted EPS. However, such material may be disposed adjacent or in close proximity to upper and/or side edges of windows and doors in the wall, where air pressure differential equalization is paramount, although no waiter drainage facility is required.

Preferably, the flame retardant material is disposed within a rigid fire resistant structure such as a small conduit formed of a metal, brick or the like, which communicates with and forms part of the channel. The conduit may thus be embedded within the EPS or, more preferably, surrounded by flame retardant material as hereinabove described.

In a most preferred embodiment the flame resistant system comprises a disparate panel of flame-resistant material as hereinabove described disposed below, but extending beyond the cross-sectional area of the channel. In one embodiment, the unit comprises a rectangularly shaped member formed of a mineral wool, glass fiber or the like which fits, wholly or partly, within an aperture wholly or partly within the cladding.

Thus, in a further aspect the invention provides cladding of a wall of a building as hereinabove defined, wherein a portion of at least one of said channels has a flame resistant fluid pervious, particulate material disposed therein so as to form a flame resistant barrier for the channel.

In a preferred aspect of the invention the cladding further comprises a member formed of a flame-retardant, fluid pervious, particulate material and disposed within, in whole or in part, said cladding 35 adjacent and in communication with at least one of said channels so as to form a flame-retardant barrier for said channel; said member having a conduit formed of a rigid, fire resistant material, which conduit has a first portion defining a first aperture in communication with said flame resistant material and a second portion defining a second aperture in communication with the atmosphere, whereby said conduit constitutes an air pressure conduit and moisture drain in indirect communication with said channel. The second aperture may be in direct or indirect communication with the atmosphere depending on whether or not an air and water pervious material is provided to prevent direct communication.

Accordingly, in yet a further aspect of the invention there is provided a flame-retardant panel for use in the cladding of a wall of a building, said panel comprising a flame-retardant, fluid pervious, particulate material; and a conduit formed of a fire resistant material and having a first portion defining a first aperture in communication with said flame-retardant material and a second portion defining a second aperture in communication with the atmosphere. Preferably the conduit is formed of a rigid material such as a metal, for example, aluminum, copper, steel and the like, or a ceramic material. The second aperture may be in direct or indirect communication with the atmosphere depending on whether it is advantageously provided with an air and water pervious layer or membrane.

The panel is preferably formed having the conduit disposed, in whole or in part, within the fire-retardant material adjacent on edge thereof. Preferably, the conduit has a substantial upstanding portion projecting from an edge of the panel of such height from the edge of the panel that when fitted, e.g., ca. 1.5 cm to correspond with the thickness of caulking typically used between individual panels of a constructed cladding of a wall. The flame resistant panels according to the invention may be of any suitable dimension, but panels of 30 cm×8 cm×5 cm, optionally provided with a back wrapping as hereinbefore described and having a metal conduit wherein the panel is adapted to fit between two adjacent insulative boards as hereinbefore described such that the lower end of the channel is disposed above the flame-retardant panel and the first aperture of the conduit, is most preferred.

It will be readily understood by the man skilled in the art that flame retardant material and/or flame retardant panels will be so disposed in the wall cladding in relation to those channels where fire retardancy and melted EPS material retardation is desired. Preferably, each 12 m×6 m expanse of wall area has a flame-retardant panel at the lower end of each channel which abuts either a structural cross-member or the top of the lower wall area expanse. Preferably, a minimum 8 cm thickness of flame-retardant material is utilized.

DESCRIPTION OF THE DRAWINGS

Thus, in order that the invention may be better understood, preferred embodiments will now be described, by way of example only, with reference to the accompanying drawings wherein:

FIG. 1B represents a perspective view of alternative insulation battens according to the invention.

FIGS. 2A–2C represent schematic cross-sectional views of insulation battens, in part, having alternative cut-away edge portions according to the invention;

Like numerals describe the same feature within the drawings.

DETAILED DESCRIPTION OF THE PRESENTLY PREFERRED EXEMPLARY EMBODIMENTS

Figure 1:
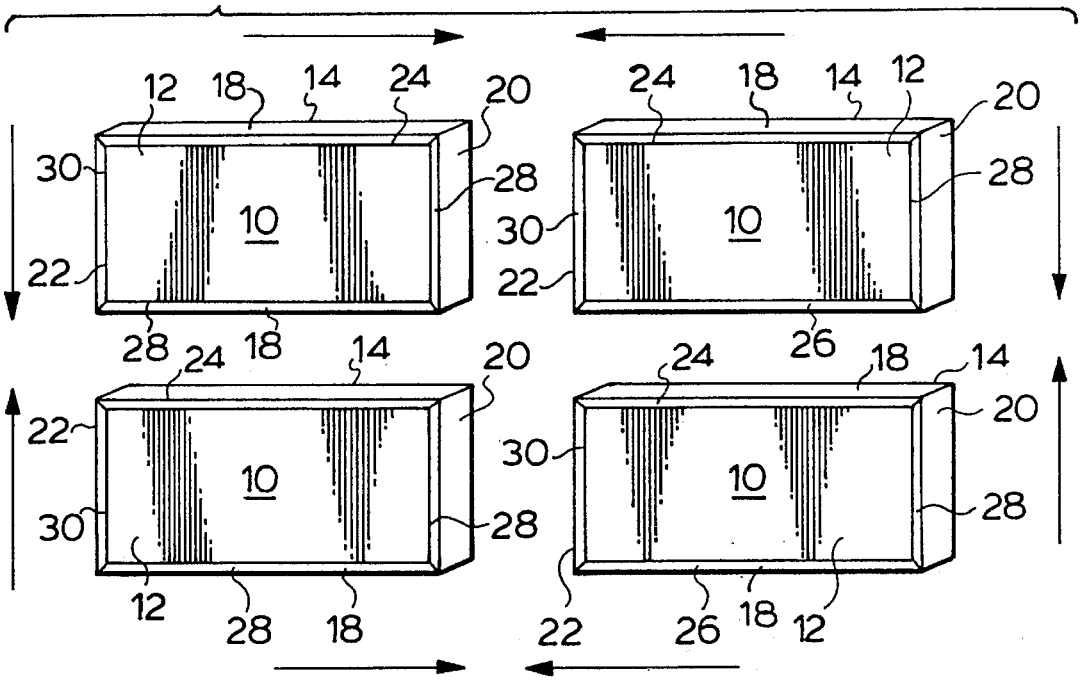
FIG. 1 represents a perspective view of a plurality of identical insulation battens according to the invention.

FIG. 1 shows a plurality of 1.2 m×0.6 m×8 cm rectangularly shaped insulation boards shown generally as 10, formed of expanded polystyrene and having a first or inner face 12, a second or outer face 14, upper face 16, lower face 18, and side faces 20, 22. Inner face 12, with faces 16, 18, 20 and 22 define 45 degree angled edges, 24, 26, 28 and 30, respectively.

FIG. 1 shows the four boards 10 in intended (as indicated by the arrows) adjacent relationship, where one board 10 abuts other boards 10, with lower faces 18 to rest on upper faces 16 of a lower board 10 and side faces 20 abutting adjacent side faces 22. The effect of this construction is to provide a plurality of surface channels, 32 shown in FIG. 1A, between boards 10. Channels 32 constitute air pressure equalization and moisture vent channels in a cladding of a wall of a building as hereinafter described.

Figure 1A:
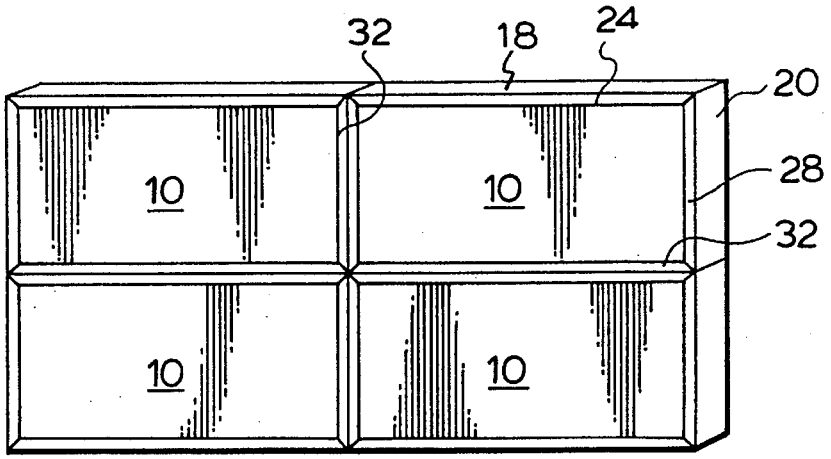
FIG. 1A represents a perspective view of the battens of FIG. 1 in cooperative adjacent relationship.

FIG. 1A shows the plurality of insulation boards 10 in cooperative, adjacent relationship as to provide insulation as a unified segment of a wall as better described hereinafter.

FIG. 1B shows a plurality of triangular shaped insulation boards shown generally as 50 having an inner face 52, side faces 54, 56 and 58, which with face 50 define 45 degree angularly shaped edges 60, 62 and 64, respectively. Cooperative, adjacent relationship construction of insulation boards 50 provides the resultant cladding with interconnecting air pressure equalization and vent channels as for the embodiment of FIG. 1A.

With reference to FIGS. 2A–2C, these Figures show, in part, insulation boards 10A, 10B and 10C having cut-away portions 40A, 40B and 40C, respectively, at edges, 42A, 42B and 42C, respectively, at inner faces, 12A, 12B and 12C, respectively. Thus, the surfaces of edges 42A define a 45 degree angled surface, edges 42B define a quadrant arcuate surface, and those of 42C define a semi-square surface.

Figure 3:
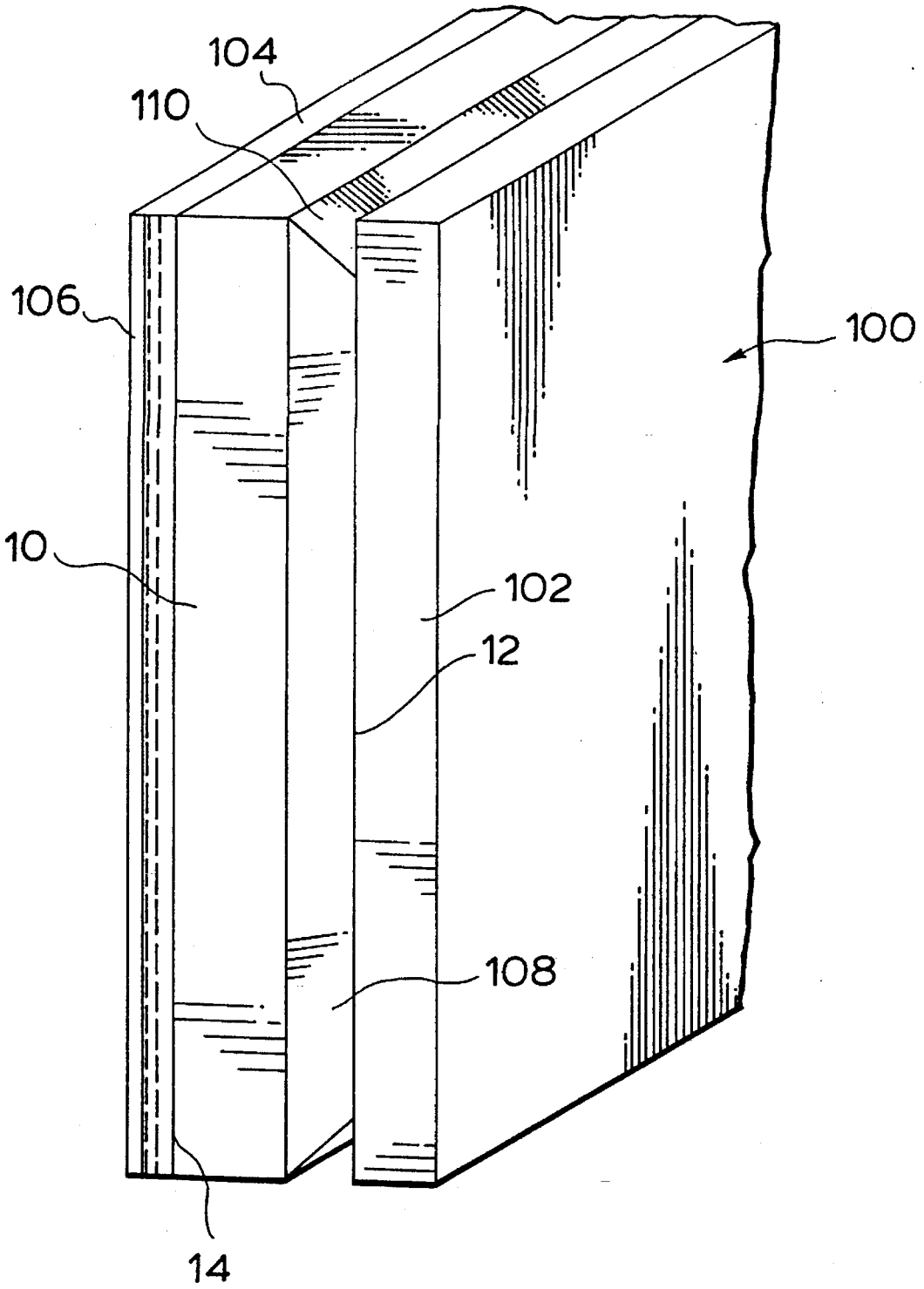
FIG. 3 represents a perspective view, partly cut-away of a multi-layered insulation batten according to the invention.

FIG. 3 shows generally as 100, a rectangularly shaped multi-layered board having a layer of insulation board 10 as described with reference to FIG. 1. Adhered to inner face 12 of board 10 is a 1.2 cm thick "GYPROCK"™ plasterboard 102 and to outer face 14 a modified basecoat 104. Basecoat 104 consists of two layers of glass fibre reinforcement mesh floated in a polymer coated modified base coat composition. To the outer surface basecoat 104 is an exterior decorative water proof 0.2 cm thick layer 106 of an acrylic polymer impregnated with sand. Board 10 has edges 108 defined as 45 degree angled surfaces which define a cutaway portion 110. Portion 110 with cooperating, adjacent boards 100 (not shown) define air pressure equalization and moisture vent channels.

Figure 9:
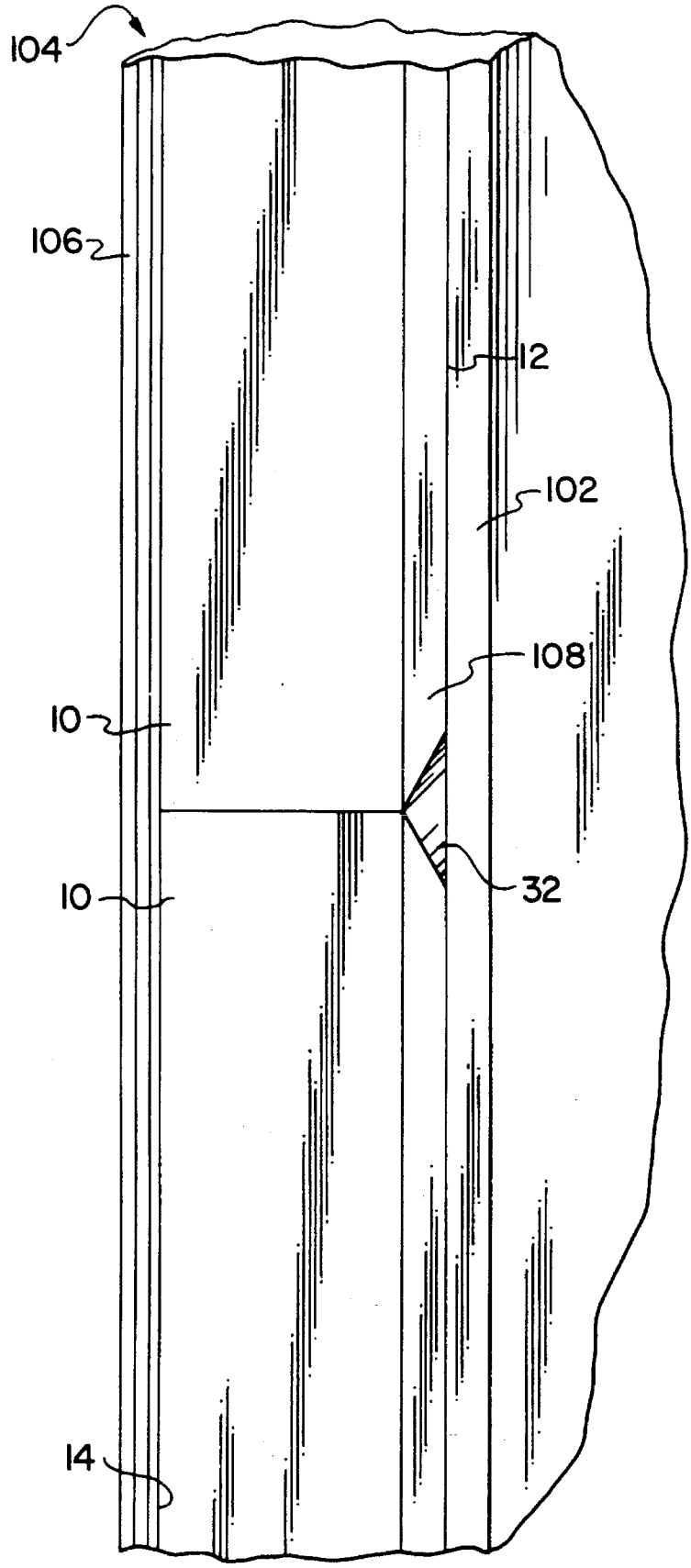
FIG. 9 is a perspective, partly cut-away view of a channel formed by insulation boards according to the present invention.

FIG. 9 shows how two of the insulation boards 10 combine to form a channel with the plasterboard 102. It will of course be understood that while this Figure shows a horizontal channel, vertical channels will be formed by other edges of the insulation boards 10, and these horizontal and vertical channels will intersect at various locations.

Figure 4:
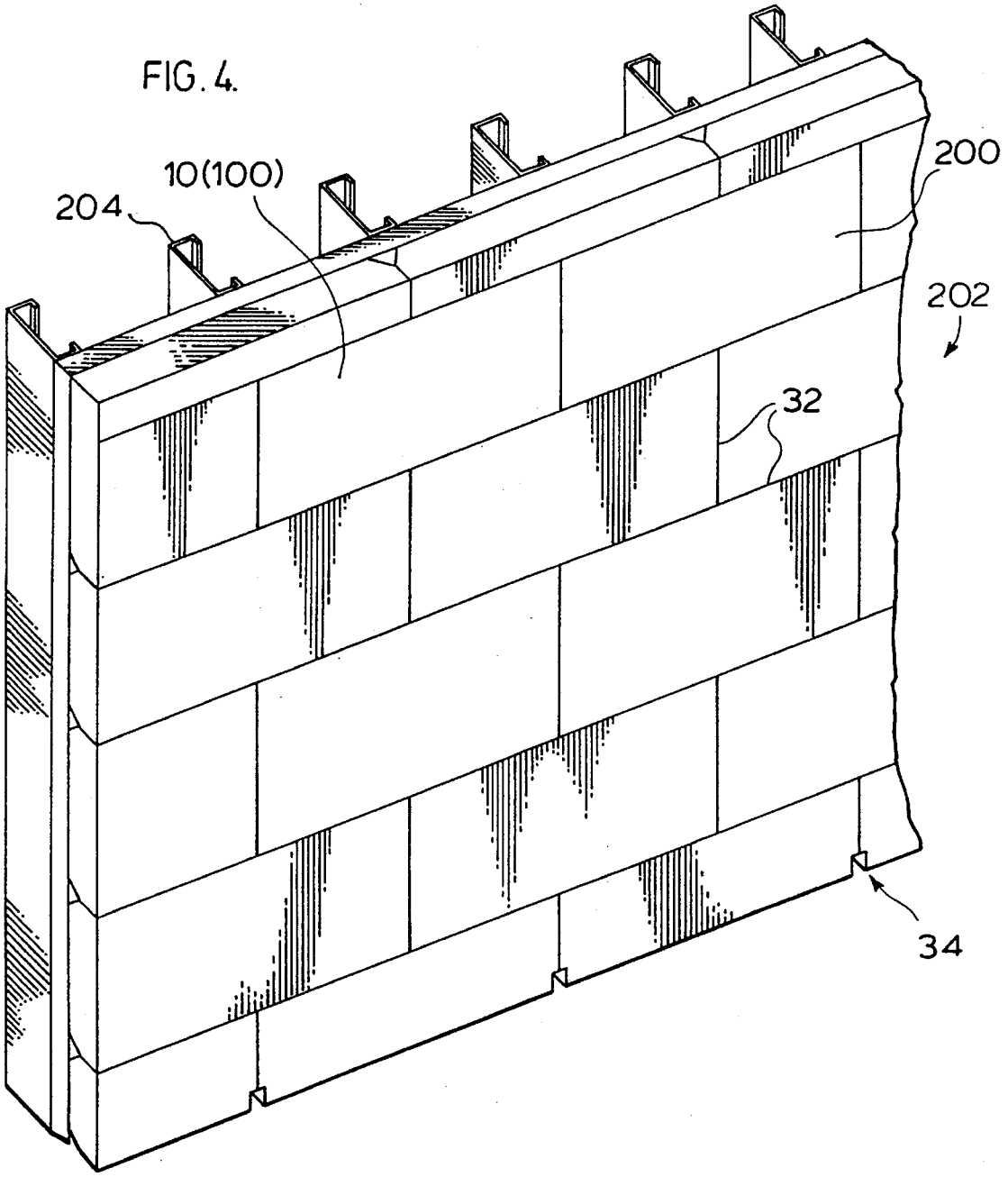
FIGS. 4 and 5 represent perspective views of wall cladding according to the invention comprising the insulation battens of FIG. 1 or FIG. 3.

FIG. 4 shown generally as 200, a cladding for the wall shown generally as 202 of a building (not shown) between structural steel supports 204.

Cladding 200 comprises a plurality of insulation boards 10 as described with reference to FIG. 1, or boards 100 as described with reference to FIG. 3.

Boards 10 or 100, as the case may be, are manually laid in the standard, cooperative adjacent one-to-one relationship as to provide insulation to the wall. As described with reference to FIGS. 1 and 1A, the array of the cut-away edged, shaped boards when so laid provide a plurality of horizontally and vertically aligned channels 32 across the inner faces of the boards within the wall cladding.

In an alternative embodiment, the cladding comprising a single full area of insulation board that may be constructed in situ and the plurality of interconnecting channels in the form of troughs defined on the surface of the insulation inscribed thereon. The resultant appearance may be as shown as for FIGS. 4 or 5.

Although within the scope of the present invention, it can be readily seen that it is not necessary that the boards 10 or 100 be so stacked such that each vertical vent channel 32 runs continuously the height of the wall should the vertical edges of the boards be vertically aligned one directly on or below a vertical edges or channels of adjacent boards, as shown with reference to FIG. 1A. Such an arrangement requires labour-attentive correct positioning of each board 10 or 100.

A significantly advantageous feature of the present invention is that the boards according to the invention can be readily, quickly and satisfactorily, operatively laid in an apparent haphazard manner one board adjacent, above or below other boards, to provide intermittent, vertically and horizontally aligned channels displaced from the vent channels of upper and lower cooperating adjacent boards. Thus, a wall so constructed with cladding according to the invention has a plurality of air pressure equalization and moisture vent channels which connect with a lower air vent oriface 34 in communication with the outside atmosphere.

Figure 5:
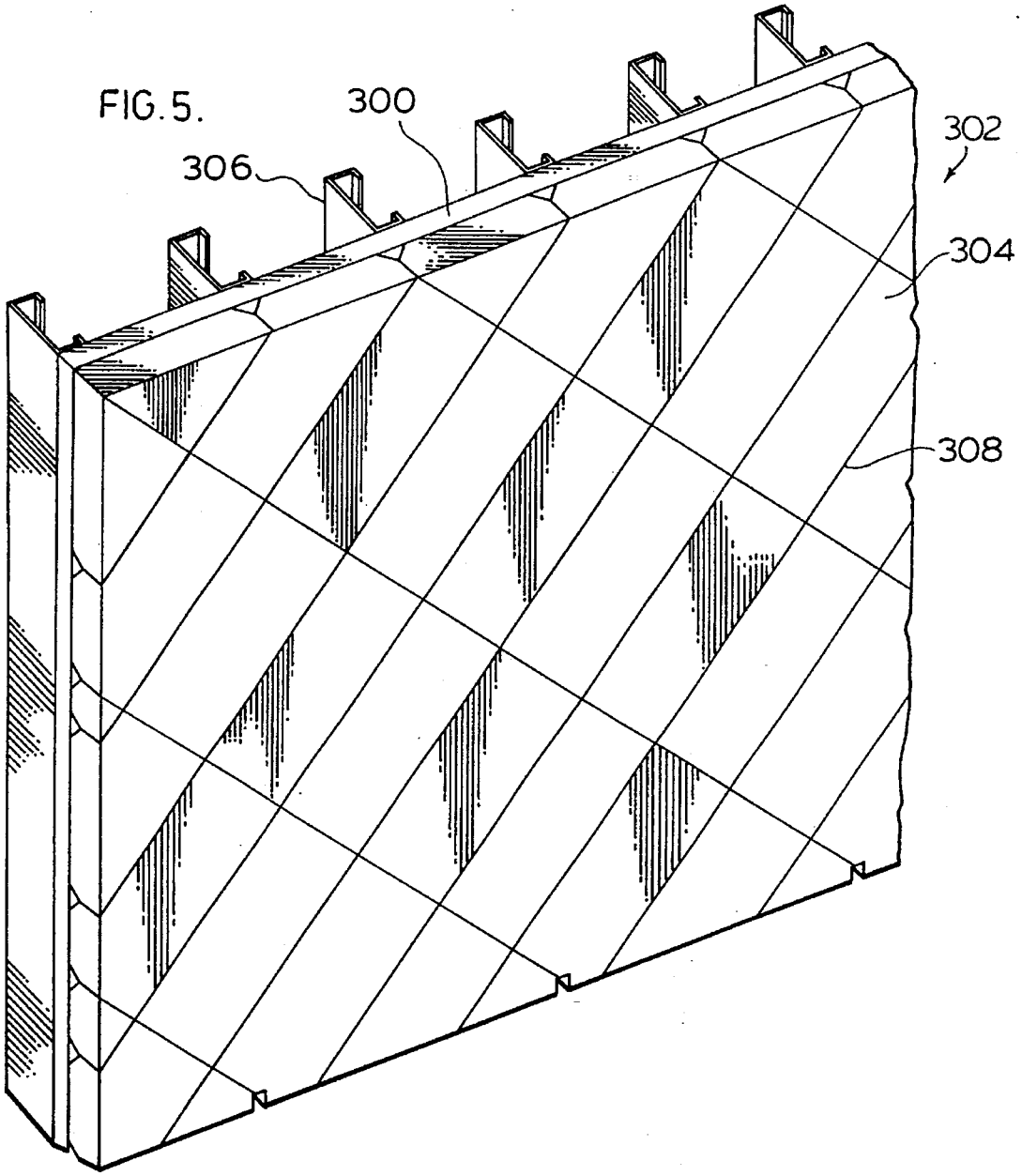

FIG. 5 represents a wall cladding shown generally as 300 of a wall shown generally as 302, and having an alternatively laid-out array of insulation boards according to the invention, wherein the boards and channels 308 are aligned at an angle of 45 degrees to the horizontal and vertical axes. In this embodiment, the rectangularly shaped boards 304 at the top, bottom, and at the side, adjacent structural supports 306 of the wall are non-rectangularly shaped, but are suitably and readily shaped, for example by the cutting of the standard board or by manufacture with a suitably shaped mold.

As described with reference to FIGS. 1, 1B and 2A–2C, the boards are laid to produce single layer insulation cladding according to the invention to which, subsequently, are adhered desired layers of plasterboard, glass fibre, polymer reinforcement and outer decoration, as the case may be, to provide a multi-layered insulation board-cladded wall. In the alternative, the cladding may be constructed to comprise the wall by methods known in the art with the multi-layered insulation boards as hereinabove described. Provided that the shape and size of the resultant air pressure equalization and moisture vent channels in the cladding of the wall are sufficient to provide satisfactory communication with the outside atmosphere, the objectives of the present invention are met. Such suitable sizes and shapes of each individual insulation board may be readily determined by the skilled person in the art.

In alternative embodiments, each of the insulation boards may have a side face portion defining a trough which provides, when in cooperative adjacent relationship with substantially identical boards, cladding with a plurality of interconnecting air pressure equalization and vent channels removed from the inner and outer faces of the insulation boards.

Figure 6:
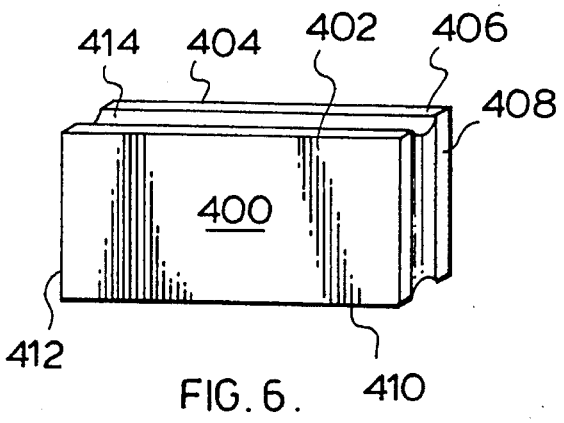
FIGS. 6, 6A, 6B and 6C represent perspective views of alternative boards according to the invention.

FIG. 6 shows a board 400 having an interface 402, outer face 404 and side faces 406, 408,410 and 412. A portion of each of side faces 406, 408,410 and 412 has centrally thereof, a trough 414 extending continuously around the side faces. Boards 400, when constructed into a cladding according to the invention in a similar manner as hereinbefore described with respect to FIG. 1, 1A, 4 and 5, provide the resultant cladding with a plurality of interconnecting air pressure equalization and moisture vent channels throughout the cladding at the edges of each insulation board 400.

In other embodiments of boards having a centrally provided trough, the trough may not extend the full length along each side nor be present on all four faces. For example, a suitable cladding may be constructed using boards having a central trough that extends only part way of one side face. Provided such an embodiment is cooperatively adjacent boards having sufficient lengths, locations and numbers of troughs to enable an, interconnecting air pressure equalization and vent channel to be formed, then the objectives of this invention are met. However, it will be readily appreciated that additional attention must be paid by the person constructing the cladding wall in order that side faces not having a trough interposed between them are not formed.

Figure 6A:
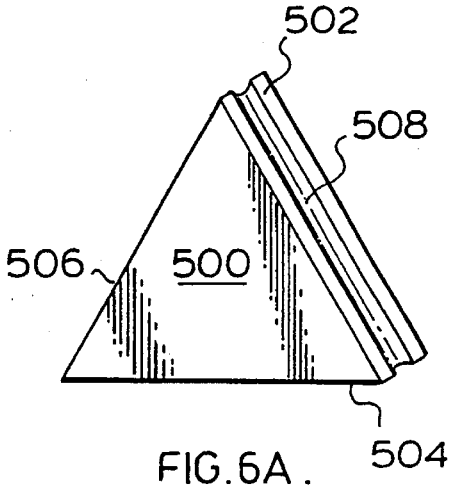

FIG. 6A shows an alternative embodiment of a board 500 of triangular shape having a centrally disposed trough 502 on each side face 504, 506 and 508. Wall cladding using boards 500 may be readily constructed as hereinabove described.

Figure 6B:
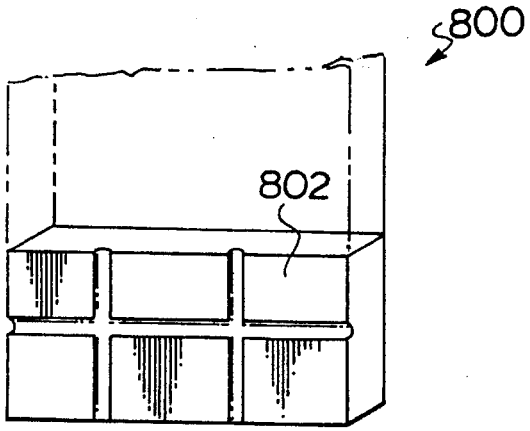

FIG. 6B shows a board 600 of rectangular shape having an inner face 602 defining a plurality of vertically aligned and laterally aligned interconnecting channels 604 and 606, respectively.

Figure 6C:
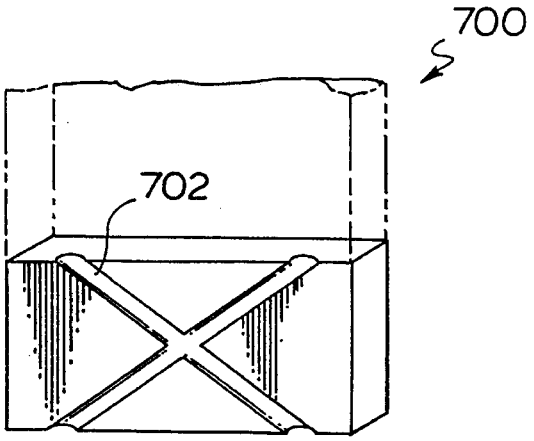

FIG. 6C shows a board 700 of rectangular shape having a portion on a face defining a trough 702 substantially in the form of diagonal interconnecting channels.

In further embodiments, rectangularly shaped and triangularly shaped boards comprising multilayered insulation boards of materials and general construction as hereinabove described, may also be made having side faces with centrally disposed troughs as hereinabove described.

Figure 7:
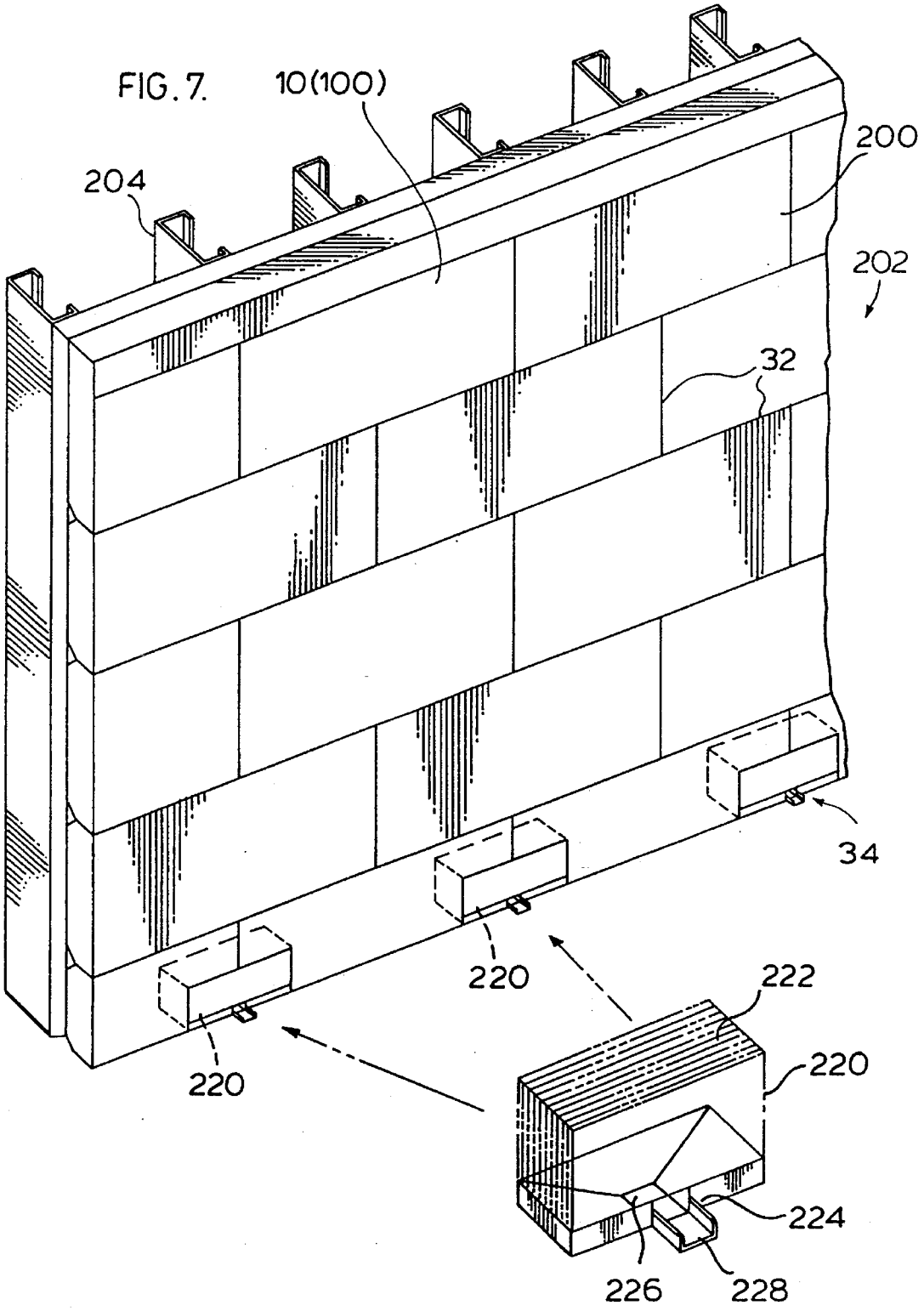
FIGS. 7 and 8 represent diagrammatic perspective views of modified wall cladding according to the invention, further comprising fire-retardant panels.

FIG. 7 shows insulation boards 10 or 100, as the case may be, of the wall as shown in FIG. 4 but having flame-retardant panels 220 comprising flame-retardant mineral wool 222 and conduit 224 having aperture 226 positioned below mineral wool 222 by which moisture percolates downwardly through to conduit 224, and an aperture 228 open to the atmosphere and acting as a spout.

Figure 8:
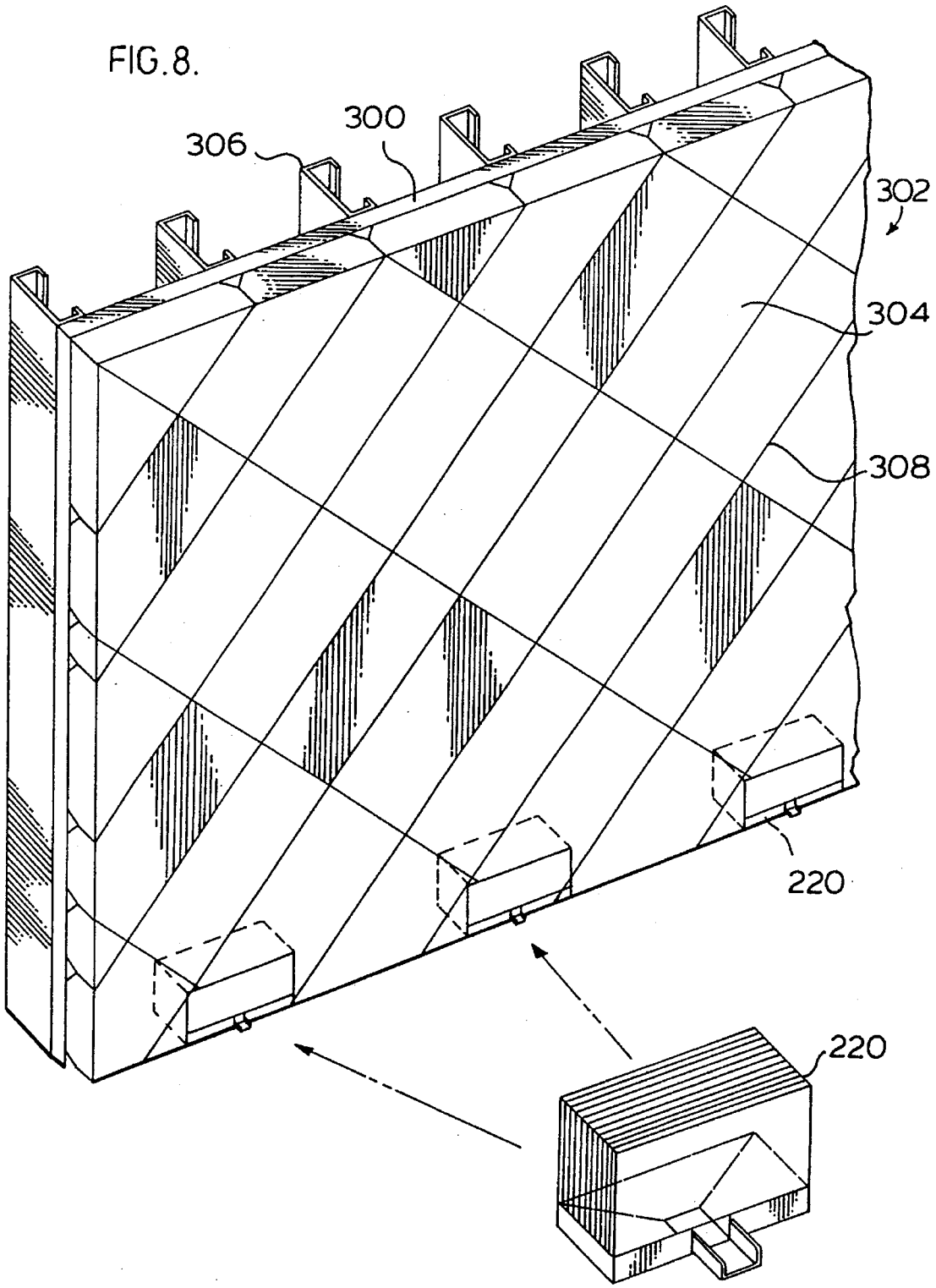

FIG. 8 represents a modified wall of FIG. 5 having the flame-retardant panel described with reference to FIG. 7. It will be readily appreciated that the spout or other drainage and air passage vents arm most preferably disposed on the wall cladding on the outer or remote side from the channels on the inside or inner parts of the wall.

With reference to FIG. 4, each of the vent channels shown therein may optionally have the fire-retardant material packed therein (not shown) or packed within a suitably shaped conduit (not shown).

Although this disclosure has described and illustrated certain preferred embodiments of the invention, it is to be understood that the invention is not restricted to those particular embodiments. Rather, the invention includes all embodiments which are, functional or mechanical equivalents of the specific embodiments and features that have been described and illustrated.

We claim:

1. A cladding assembly for a building wall, said cladding assembly comprising:

a first board having a first channel surface; and a second board having a second channel surface, said second board being adjacent to said first board, said second channel surface being adjacent to said first channel surface and sharing a common edge with said first board channel surface;

wherein said first and second channel surfaces cooperatively define at least part of a cladding channel between said first and second boards, said first and second channel surfaces defining a vertex of said Channel, with said channel tapering from said vertex, said channel passing at least one of moisture and air therethrough.

2. The cladding assembly of claims 1, further comprising:

a third board having a third channel surface;

wherein at least one of said first and second boards has an additional channel surface; and said third channel surface and said additional channel surface cooperatively define at least part of an additional cladding channel therebetween, said additional channel passing at least one of moisture and air therethrough.

3. The cladding assembly of claim 2, wherein said cladding channel and said additional cladding channel communicate with one another.

4. The cladding assembly of claim 2, wherein said cladding channel and said additional cladding channel intersect one another at a predetermined angle.

5. The cladding assembly of claim 4, wherein said predetermined angle of said intersection is ninety degrees.

6. The cladding assembly of claim 4, wherein said predetermined angle of said intersection is sixty degrees.

7. The cladding assembly of claim 1, further comprising:

a third board having a third channel surface; and a fourth board having a fourth channel surface, said fourth board being adjacent to said third board, said fourth channel surface being adjacent to said third channel surface and sharing a common edge with said third channel surface;

wherein said third and fourth channel surfaces cooperatively define at least part of a cladding channel between said third and fourth boards, said channel passing at least one of moisture and air therethrough; and said channel formed by said first and second boards communicates with said channel formed by said third and fourth boards at respective ends thereof.

8. The cladding assembly of claim 7, further comprising a composite channel extending substantially across a full area of said cladding assembly, said composite channel including said channel formed by said first and second boards and said channel formed by said third and fourth boards.

9. The cladding assembly of claim 1, wherein said first board channel surface and said second board channel surface collectively define less than an entire portion of said cladding channel.

10. The cladding assembly of claim 1, wherein at least one of said channel surfaces intersects with an exterior surface of a respective one of said first and second boards at an exterior surface thereof.

11. The cladding assembly of claim 1, wherein at least one of said channel surfaces is a surface selected from the group consisting of a quadrant arcuate surface, a 45 degree angled surface and a semi-square surface.

12. The cladding assembly of claim 1, wherein said boards are of rectangularly-shaped form.

13. The cladding assembly of claim 1, wherein said boards are of triangularly-shaped form.

14. The cladding assembly of claim 1, wherein said channel is vertically or horizontally aligned.

15. The cladding assembly of claim 1, wherein said channel is aligned at an angle selected from 30 degrees to 60 degrees from a vertical axis of the assembly.

16. The cladding assembly of claim 1, wherein at least one of said boards comprises one or more layers of material selected from the group consisting of expanded polystyrene, polyurethane, urea-formaldehyde, glass fibre, plasterboard, mineral wool and polymer based particulate matter composition.

17. The cladding assembly of claim 1, further comprising a flame-retardant, fluid pervious, particulate material adjacent and in communication with said channel to form a flame-retardant barrier for said channel.

18. A cladding assembly for a building wall, said cladding assembly comprising:

a first board having a first channel surface;

a second board having a second channel surface, said second board being adjacent to said first board, said second channel surface being adjacent to said first channel surface and sharing a common edge with said first channel surface, said first and second channel surfaces cooperatively defining at least part of a cladding channel between said first and second boards, said channel passing at least one of moisture and air therethrough; and a flame-retardant, fluid pervious, particulate material adjacent and in communication with said channel to form a flame-retardant barrier for said channel.

19. The cladding assembly of claim 18, further comprising: a third board having a third channel surface;

wherein at least one of said first and second boards has an additional channel surface; and said third channel surface and said additional channel surface cooperatively define at least part of an additional cladding channel therebetween, said additional channel passing at least one of moisture and air therethrough.

20. The cladding assembly of claim 19, wherein said cladding channel and said additional cladding channel communicate with one another.

21. The cladding assembly of claim 19, wherein said cladding channel and said additional cladding channel intersect one another at a predetermined angle.

22. The cladding assembly of claim 21, wherein said predetermined angle of said intersection is ninety degrees.

23. The cladding assembly of claim 21, wherein said predetermined angle of said intersection is sixty degrees.

24. The cladding assembly of claim 18, further comprising:

a third board having a third channel surface; and a fourth board having a fourth channel surface, said fourth board being adjacent to said third board, said fourth channel surface being adjacent to said third channel surface and sharing a common edge with said third channel surface;

wherein said third and fourth channel surfaces cooperatively define at least part of a cladding channel between said third and fourth boards, said channel passing at least one of moisture and air therethrough; and said channel formed by said first and second boards communicates with said channel formed by said third and fourth boards at respective ends thereof.

25. The cladding assembly of claim 24, further comprising a composite channel extending substantially across a full area of said cladding assembly, said composite channel including said channel formed by said first and second boards and said channel formed by said third and fourth boards.

26. The cladding assembly of claim 18, wherein said first board channel surface and said second board channel surface collectively define less than an entire portion of said cladding channel.

27. The cladding assembly of claim 18, wherein at least one of said channel surfaces intersects with an exterior surface of a respective one of said first and second boards at an exterior surface thereof.

28. The cladding assembly of claim 18, wherein at least one of said channel surfaces is a surface selected from the group consisting of a quadrant arcuate surface, a 45 degree angled surface and a semi-square surface.

29. The cladding assembly of claim 18, wherein said boards are of rectangularly-shaped form.

30. The cladding assembly of claim 18, wherein said boards are of triangularly-shaped form.

31. The cladding assembly of claim 18, wherein said channel is vertically or horizontally aligned.

32. The cladding assembly of claim 18, wherein said channel is aligned at an angle selected from 30 degrees to 60 degrees from a vertical axis of the assembly.

33. The cladding assembly of claim 18, wherein at least one of said boards comprises one or more layers of material selected from the group consisting of expanded polystyrene, polyurethane, urea-formaldehyde, glass fibre, plasterboard, mineral wool and polymer based particulate matter composition.

* * * * *